United States Patent [19]

Albano

[11] 4,102,525

[45] Jul. 25, 1978

[54] KNOCKDOWN SUPPORT AND SPACER FOR BOOKSHELVES

[76] Inventor: Robert Norman Albano, 5357 La Jolla Blvd., La Jolla, Calif. 92037

[21] Appl. No.: 768,217

[22] Filed: Feb. 14, 1977

[51] Int. Cl.[2] ..... A45D 19/04

[52] U.S. Cl. ..... 248/174; 229/15; 108/51.3; 248/165; 248/188.6

[58] Field of Search ..... 108/51.3, 56.1, 56.3; 248/188.1, 165, 166, 174, 150, 152, 188.6; 297/442; 229/27, 28 R, 15; 312/258

[56] References Cited

U.S. PATENT DOCUMENTS

| | | | |
|---|---|---|---|
| 3,519,190 | 7/1970 | Achermann et al. | 108/51.3 X |
| 3,532,310 | 10/1970 | Finfrock | 248/150 X |
| 3,683,822 | 4/1970 | Roberts | 108/51.3 |
| 3,752,089 | 9/1971 | Bartels | 108/51.3 X |
| 3,853,259 | 12/1974 | Tupper | 229/15 |
| 3,942,636 | 3/1976 | Matsuyama et al. | 24/204 X |

FOREIGN PATENT DOCUMENTS

| | | | |
|---|---|---|---|
| 1,134,601 | 11/1968 | United Kingdom | 108/51.3 |

*Primary Examiner*—Roy D. Frazier
*Assistant Examiner*—Peter A. Aschenbrenner
*Attorney, Agent, or Firm*—Brown & Martin

[57] ABSTRACT

A knockdown support block for bookshelves or the like comprises a plurality of substantially rigid rectangular panels having the side edges thereof connected together by hinge like structure into a string of panels with connectors marketed under the trademark Velcro at the end panels and an intermediate panel so that the panels can be folded back and connected into a block or column of generally rectangular cross section.

7 Claims, 4 Drawing Figures

KNOCKDOWN SUPPORT AND SPACER FOR BOOKSHELVES

BACKGROUND OF THE INVENTION

The present invention relates to support structures and pertains particularly to a knockdown support block or column.

Bookshelves are frequently constructed in a modular fashion with shelves spaced apart by spacing means such as bricks and concrete blocks. Such shelving while sturdy and attractive is extremely heavy and difficult to move and transport. Support blocks for such structures must have sufficient strength to support fairly heavy items such as books and the like and at the same time be sufficiently light as to be portable. Such blocks or support members also have sufficient width to insure stability of the structure.

Accordingly it is desirable that a support or spacer block or the like be available which is both light in weight and has sufficient structural strength and width to support heavy loads.

SUMMARY AND OBJECTS OF THE INVENTION

Accordingly the primary object of the present invention is to provide a knockdown spacer block for bookshelves and the like.

Another object of the present invention is to provide a knockdown spacer block having high strength and rigidity, yet is light weight and easily portable.

In accordance with the primary aspect of the present invention a spacer block is constructed of a plurality of panels of substantially rigid material connected together to be quickly formed into a support column or knocked down into a flat structure.

BRIEF DESCRIPTION OF THE DRAWING

The above and other objects and advantages of the present invention will become apparent from the following description when read in conjunction with the drawings, wherein.

DETAILED DESCRIPTION OF THE PREFERRED EMBODIMENT

Figure 1:
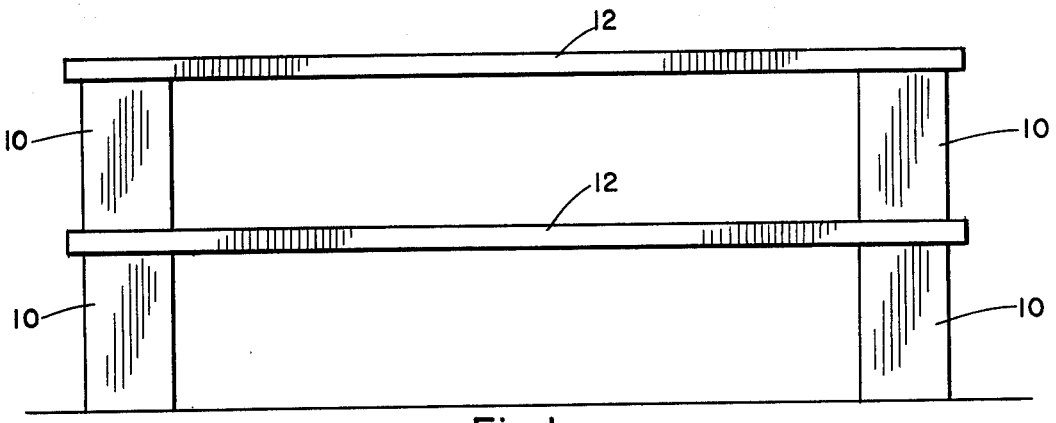
FIG. 1 is a side elevation view of a typical bookshelf using four of the support units.

Turning now to the drawing, particularly FIG. 1, there is illustrated a plurality of units in accordance with the present invention, generally designated by the numeral 10 in their assembled position and supporting a pair of shelf members 12.

Figure 2:
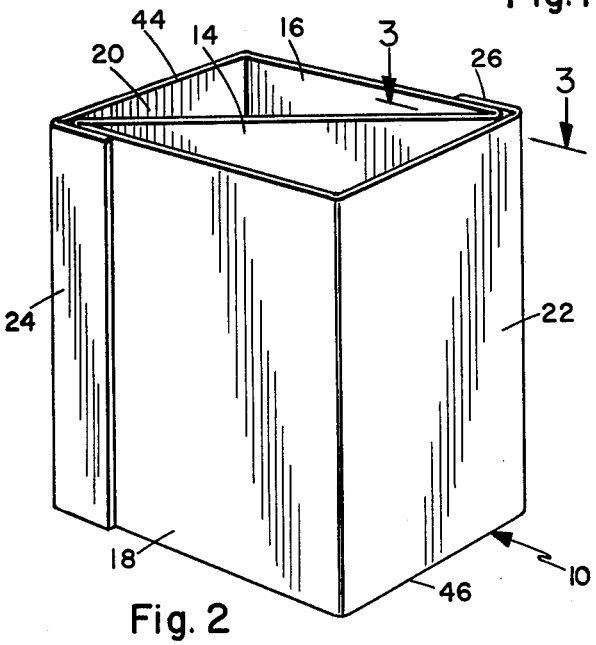
FIG. 2 is a perspective view of a support unit.

Turning now to FIG. 2 of the drawing, there is illustrated a unit of the present invention in perspective view showing the support block or column in its assembled position. The structure is constructed of a plurality of panels connected together by suitable hinge means for folding or hinging into the support position, as illustrated.

The support block or column comprises a plurality of substantially rigid rectangular panels including a central or middle panel 14 connected by suitable hinge means at its sides to adjacent intermediate panels 16 and 18, which in turn are hingedly connected at their sides to end panels 20 and 22. The end panels 20 and 22 each include a connecting tab or flap 24 and 26, each respectively having suitable connecting means thereon, such as hook material 28 and 30. Fabric material 32 and 34 is connected at side edges of panels 16 and 18 which are hinged to the center of diagonal panel 14.

Figure 3:
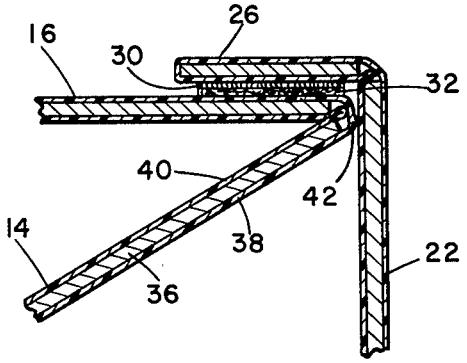
FIG. 3 is an enlarged sectional view taken on line 3—3 of FIG. 2.
Figure 4:
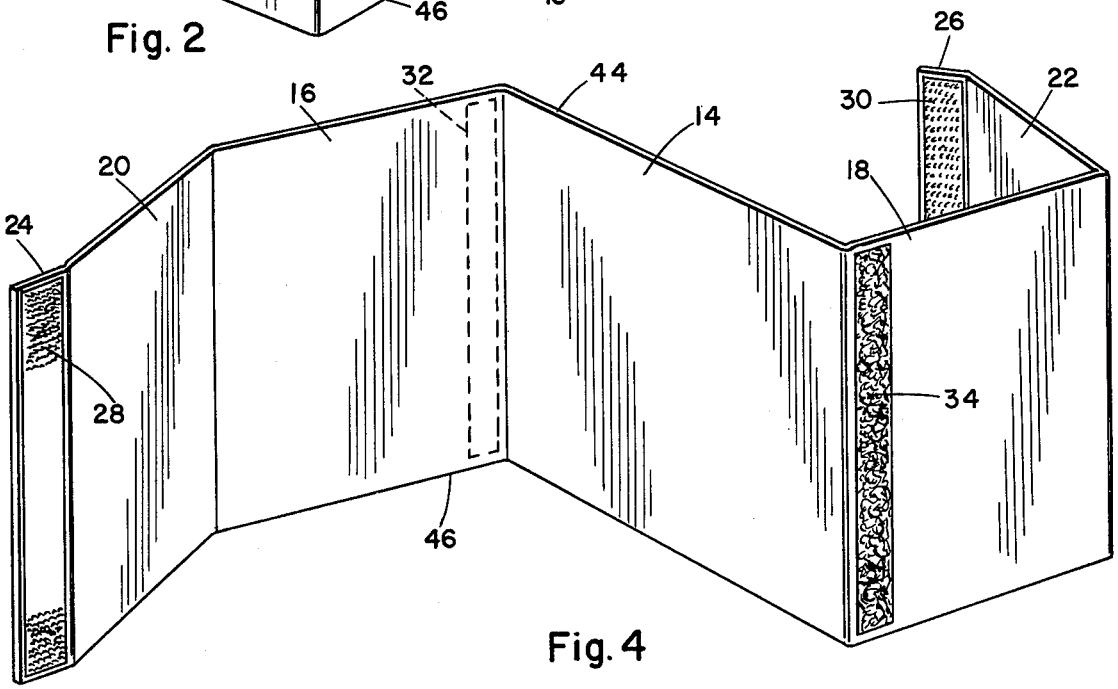
FIG. 4 is a perspective view of the support unit partially opened.

Turning now to the detailed FIG. 3, each of the panels comprises an inner board member 36 of a substantially rigid structural material sandwiched between a pair of flexible sheets 38 and 40. These flexible sheets may completely encompass or encloses all of the panel members and, at the edges of the panel members, include sufficient excess of material to define hinge means 42. The hinge means comprises the connection of the covering material extending between the adjacent edges of the adjacent panel members.

The inner board member 36 may be any suitable thin sheet of substantially rigid material such as cardboard, particle board, wood, or the like. It will also be appreciated that the hinge structure need only be a flexible strip extending between adjacent panels and need not necessarily cover the entire assembly as shown. For example, strips of tape secured between the adjacent panels could serve this function.

The support article that is herein described may be defined as a block or column for supporting spaced members such as shelves or the like. The assembled panels have continuous parallel upper and lower edges 44 and 46, respectively. The panels are each connected to adjacent panels at the side edges. The upper and lower edges 44 and 46 are oriented along transverse to the axis of the column or block as shown in FIG. 2 and serve as the support surface thereof.

As shown in FIG. 2, the central or diagonal panel 14 extends diagonally across through the center of the block to opposite corners where the connecting members 32 and 34 are engaged by the connecting members 28 and 30. Thus the two end panels 20 and 22 fold over and connect to the edge of the opposite intermediate panels 16 and 18 at the connection thereof to the central or diagonal panel 14. The diagonal panel 14 reinforces the block and ties the sides together in a rigid manner. It will be appreciated that this construction provides a rather strong yet lightweight support column or block. Also the support column or block 10 may be knocked down to lie in a flat position to be easily transportable. It can then be readily and easily assembled into a supporting configuration. It will also be appreciated that the cross sectional configuration may be either rectangular or square as desired and that the length thereof may vary from that such as a support block or extend upward to define a column.

While the present invention has been illustrated and described by means of a specific embodiment it is to be understood that numerous changes and modifications may be made therein within the scope of the invention as defined in the appended claims.

Having described my invention, I now claim:

1. A knockdown support column comprising:

a plurality of substantially rigid rectangular panels having top, bottom, and side edges, hinge means connecting said panels along said side edges into a string having first and second end panels having a free edge and a plurality of intermediate panels, and connecting means on said free edge for connecting said free edge to an intermediate one of said panels when said panels are hinged to a position for defining a four sided three dimensional column having a plurality of sides each defined by a separate one of said panels including said end panels, said end panels defining opposite sides of said column.

2. The support column of claim 1, wherein said plurality comprises five panels, one of said intermediate panels extending diagonally across said three dimensional column.

3. The support column of claim 2, wherein said one panel is the center panel in said string.

4. The support column of claim 1, wherein said connecting means comprises a tab on said free edge and hook and pile fastening means marketed under the trademark Velcro on said tab and on the side panel adjacent said free end for connecting said side panels together.

5. The support column of claim 3, wherein said connecting means comprises a tab on said free edge, and hook and pile fastening means on said tab for engaging hook and pile fastening means on an intermediate one of said panels, said fastening means marketed under the trademark Velcro.

6. The support column of claim 5, wherein each of said panels comprises a rectangular cardboard sheet, and said hinge means comprise flexible sheet material connected between adjacent panels.

7. The support column of claim 6, wherein said sheet material encases said cardboard sheets.

* * * * *